US009221267B2

(12) United States Patent
Ishihara

(10) Patent No.: US 9,221,267 B2
(45) Date of Patent: Dec. 29, 2015

(54) PRINTER, TERMINAL DEVICE, AND METHOD FOR OBTAINING INFORMATION

(71) Applicant: FUNAI ELECTRIC CO., LTD., Osaka (JP)

(72) Inventor: Mikio Ishihara, Kobe (JP)

(73) Assignee: FUNAI ELECTRIC CO., LTD., Osaka (JP)

( * ) Notice: Subject to any disclaimer, the term of this patent is extended or adjusted under 35 U.S.C. 154(b) by 0 days.

(21) Appl. No.: 14/670,610

(22) Filed: Mar. 27, 2015

(65) Prior Publication Data

US 2015/0273855 A1 Oct. 1, 2015

(30) Foreign Application Priority Data

Mar. 28, 2014 (JP) ..... 2014-069800

(51) Int. Cl.
*B41J 2/21* (2006.01)

(52) U.S. Cl.
CPC ..... *B41J 2/21* (2013.01)

(58) Field of Classification Search
CPC ..... B41J 2/175; B41J 2/1755; B41J 2/195; B41J 2/1652
See application file for complete search history.

(56) References Cited

U.S. PATENT DOCUMENTS 5,617,122 A * 4/1997 Numata et al. ..... 347/14
2010/0028067 A1* 2/2010 Wanibuchi et al. ..... 400/621

FOREIGN PATENT DOCUMENTS

| | | | |
|---|---|---|---|
| JP | 6-262769 | | 9/1994 |
| JP | 8-118673 | | 5/1996 |
| JP | 8-251363 | | 9/1996 |
| JP | 10-329337 | | 12/1998 |
| JP | 2001-293911 | | 10/2001 |
| JP | 2004-114591 | | 4/2004 |
| JP | 2007-261098 | | 10/2007 |
| JP | 2007261098 | A * | 10/2007 |

* cited by examiner

*Primary Examiner* — Sarah Al Hashimi
(74) *Attorney, Agent, or Firm* — Wenderoth, Lind & Ponack, L.L.P.

(57) ABSTRACT

A printer including: a detection unit which detects first remaining amounts of inks; a generation unit which generates a plurality of mixed color information on mixed colors having different distribution densities of the inks, the plurality of mixed color information each including a mixed color and second remaining amounts of the inks representing estimated remaining amounts of the inks based on the first remaining amounts if the mixed color were to be used for printing; and an obtaining unit which obtains mixed color information selected from the plurality of mixed color information.

13 Claims, 9 Drawing Sheets

PRINTER, TERMINAL DEVICE, AND METHOD FOR OBTAINING INFORMATION

CROSS REFERENCE TO RELATED APPLICATION

The present application is based on and claims priority of Japanese Patent Application No. 2014-069800 filed on Mar. 28, 2014. The entire disclosure of the above-identified application, including the specification, drawings and claims is incorporated herein by reference in its entirety.

FIELD

The present invention relates to a printer and the like which can print using a plurality of mixed colors having different distribution densities of a plurality of coloring materials.

BACKGROUND

A color printer, for example, uses coloring materials of four colors (black, yellow, magenta, cyan) to print an image onto a recording medium (e.g., copier paper, photo paper, a label side of a disk medium, etc.). A coloring material is a raw material for rendering a color on a recording medium, for example, inks and toners. A technique is disclosed in which if one of coloring materials of four colors in such a color printer is exhausted, a color of the exhausted coloring material is rendered using a mixed color obtained from the other coloring materials (e.g., see Patent Literature (PTL) 1).

CITATION LIST

Patent Literature

[PTL 1] Japanese Unexamined Patent Application Publication No. H08-118673

SUMMARY

Technical Problem

Under conventional techniques, however, it is difficult to determine a mixed color suitable for user's visual tolerances and the remaining amounts of a plurality of coloring materials.

Thus, the present invention provides a printer and the like which can obtain a mixed color that is suitable for user's visual tolerances and the remaining amounts of a plurality of coloring materials.

Solution to Problem

A printer according to one aspect of the present invention includes: a detection unit that detects first remaining amounts of inks; a generation unit that generates a plurality of mixed color information on mixed colors having different distribution densities of the inks, the plurality of mixed color information each including a mixed color among the mixed colors and second remaining amounts of the inks representing estimated remaining amounts of the inks based on the first remaining amounts if the mixed color were to be used for printing; and an obtaining unit that obtains mixed color information selected from the plurality of mixed color information.

A terminal device according to one aspect of the present invention includes: a reception unit that receives, from a printer, a plurality of mixed color information on mixed colors having different distribution densities of inks, the plurality of mixed color information each including a mixed color among the mixed colors, and second remaining amounts of the inks representing estimated remaining amounts of the inks if the mixed color were to be used for printing; a selection unit that selects mixed color information from the plurality of mixed color information; and a transmission unit that transmits the selected mixed color information to the printer.

It should be noted that the present invention can be implemented not only as a printer and a terminal device which include such characteristic components but also as a method which includes, as steps, processes which are performed by the characteristic components included in the printer or the terminal device. The present invention can also be implemented as a program for causing a computer to function as the characteristic components included in the printer, or a program for causing a computer to execute the characteristic steps included in the method. Such a program can, of course, be distributed in a non-transitory computer-readable storage medium such as a compact disc read only memory (CD-ROM) and via a communication network such as the Internet.

Advantageous Effects

A printer according to one aspect of the present invention can obtain mixed color information suitable for user's visual tolerances and the remaining amount of a plurality of coloring materials.

BRIEF DESCRIPTION OF DRAWINGS

These and other objects, advantages and features of the invention will become apparent from the following description thereof taken in conjunction with the accompanying drawings that illustrate a specific embodiment of the present invention.

DESCRIPTION OF EMBODIMENTS

Hereinafter, embodiments will be described in detail, with reference to the accompanying drawings.

The embodiments described below are generic and specific illustration of the present invention. Values, shapes, materials, components, arrangement or connection between the components, steps, and the processing order of the steps are merely illustrative, and are not intended to limit the appended claims. Therefore, among components in the following embodiments, components not recited in any one of the independent claims are described as arbitrary components.

Embodiment 1

The present embodiment will be described with reference to the case where a printer is an inkjet printer.

Figure 1:
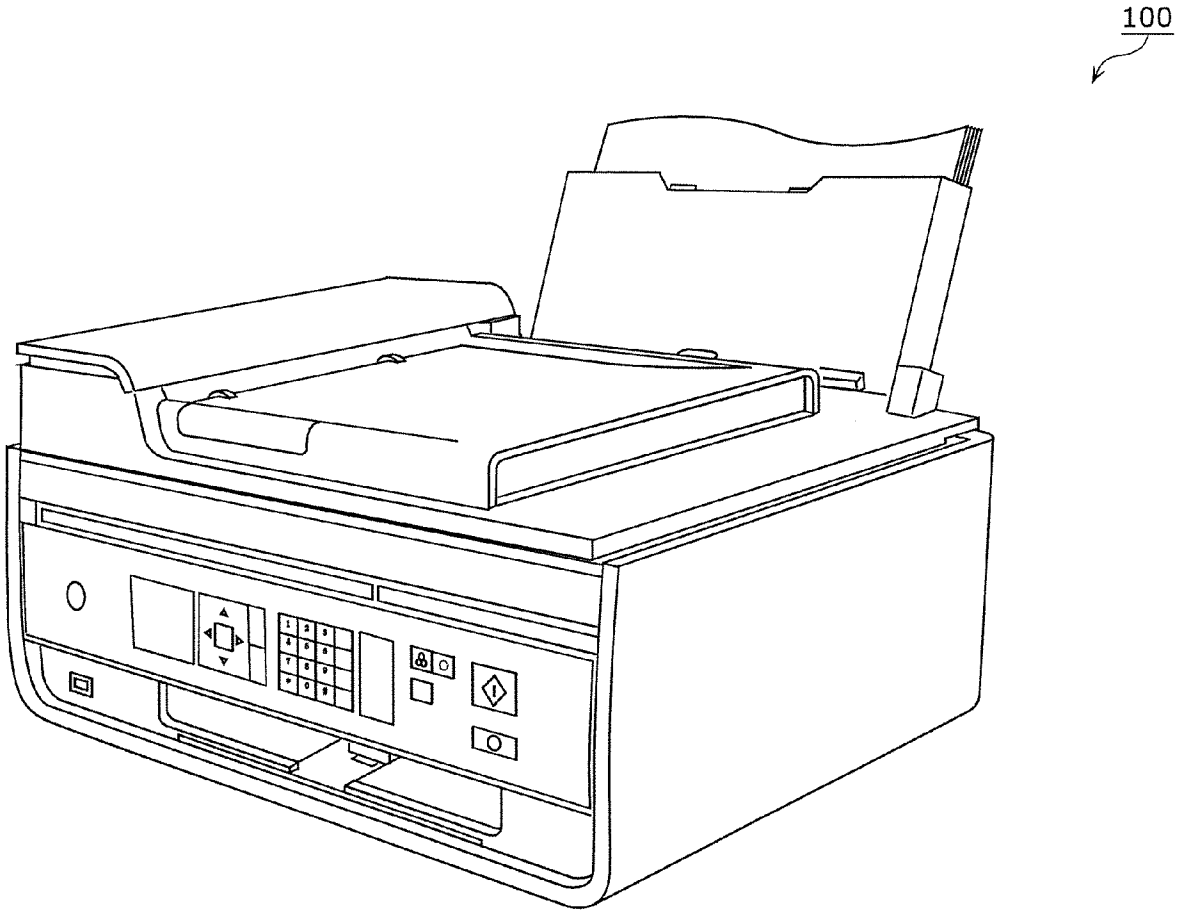
FIG. 1 is a perspective view showing an appearance of a printer according to an embodiment 1.

FIG. 1 is a perspective view showing an appearance of the printer according to an embodiment 1.

A printer 100 according to the present embodiment can render an alternative color of one ink color (hereinafter, also referred to as an "original color") among a plurality of inks of different colors, using the other inks among the plurality of inks. For example, if the printer 100 incorporates one ink cartridge which includes four color (black, yellow, magenta, cyan) inks, the printer 100 can use yellow, magenta, and cyan inks to render an alternative color of black.

[Functional Configuration of Printer]

Figure 2:
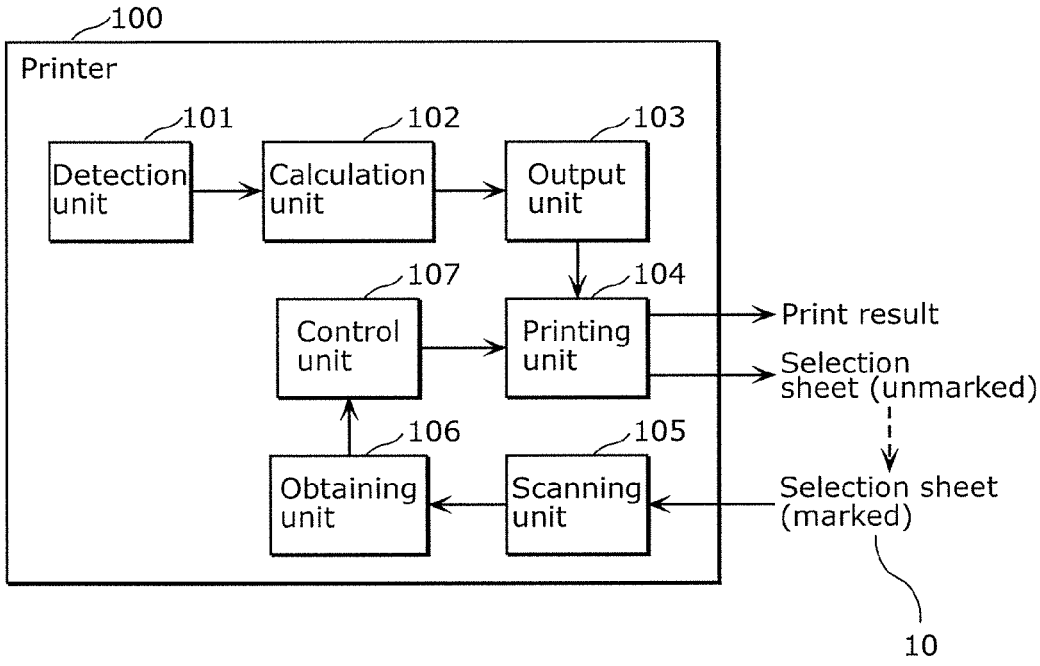
FIG. 2 is a block diagram showing functional configuration of the printer according to the embodiment 1.

Functional configuration of the printer 100 will be described. FIG. 2 is a block diagram showing the functional configuration of the printer according to the embodiment 1. As shown in FIG. 2, the printer 100 includes a detection unit 101, a calculation unit 102, an output unit 103, a printing unit 104, a scanning unit 105, an obtaining unit 106, and a control unit 107.

The detection unit 101 detects remaining amounts (first remaining amounts) of a plurality of inks. Specifically, the detection unit 101, for example, counts the number of times each ink is ejected from a nozzle to detect the remaining amount of the ink. Also for example, the detection unit 101 may obtain output of an ink-level sensor mounted within the ink cartridge to detect the remaining amount of the ink.

For each of mixed colors as alternatives to an ink color, the calculation unit 102 calculates, based on the detect remaining amounts of the inks, estimated remaining amounts (second remaining amounts) of inks remaining if the mixed color were to be used for printing. In other words, the calculation unit 102 estimates, for each mixed color, the estimated remaining amounts of inks if the mixed color were to be used.

Here, the mixed colors are alternative colors of one of original color inks among the plurality of inks. The mixed colors have different distribution densities of a plurality of inks. For example, if the mixed colors are alternative colors of black, the mixed colors include colors which are rendered using yellow, magenta, and cyan in ratios of (1:1:1), (0.9:1:1), (1:0.9:1), and (1:1:0.9).

In other words, for example, for each of mixed colors which are rendered using yellow, magenta, and cyan inks, the calculation unit 102 calculates, based on the remaining amounts of yellow, magenta, and cyan inks detected by the detection unit 101, estimated remaining amounts of the yellow, magenta, and cyan inks remaining if the mixed color were to be used for printing.

The output unit 103 outputs a plurality of pieces of mixed color information on the plurality of mixed colors. The mixed color information includes a mixed color and the calculated remaining amounts (the second remaining amounts) of color inks corresponding to the mixed color. For example, the mixed color information includes numerical values of red, green, and blue representing a mixed color in RGB color model, and percentages of the remaining amounts of inks relative to the maximum volumes. In the present embodiment, the output unit 103 outputs a plurality of pieces of mixed color information to the printing unit 104. The calculation unit 102 and the output unit 103 correspond to a generation unit which generates a plurality of mixed color information on mixed colors having different distribution densities of the inks.

The printing unit 104 prints color samples for the plurality of mixed colors and an indication of the remaining amounts of color inks onto a recording medium, based on the plurality of pieces of mixed color information. Here, a recording medium on which the color samples for the plurality of mixed colors and the indication of the remaining amount of color inks are printed will be referred to as a mixed color selection sheet. The mixed color selection sheet will be described below, with reference to FIG. 3.

The scanning unit 105 is, for example, a flatbed contact image sensor (CIS) scanner or a flatbed CCD (charge-coupled device) scanner. The scanning unit 105 scans a recording medium marked by a user. In other words, the scanning unit 105 optically scans a marked selection sheet.

The obtaining unit 106 obtains at least one piece of mixed color information selected by the user, from the plurality of pieces of mixed color information, based on the plurality of pieces of mixed color information. Specifically, the obtaining unit 106 obtains at least one mixed color information selected by the user in consideration of the plurality of pieces of mixed color information. In other words, the obtaining unit 106 obtains one piece of mixed color information selected from the plurality of pieces of mixed color information.

Here, the obtaining unit 106 obtains mixed color information selected by the user, based on a result of scanning the marked selection sheet. In other words, the obtaining unit 106 recognizes a mark made by the user from a scan result (an image) to obtain mixed color information selected by the user.

The control unit 107 determines a mixed color to be used in printing as an alternative to an original color, based on a result obtained by the obtaining unit 106. The control unit 107 then prints print data, using the determined mixed color via the printing unit 104. In other words, the printing unit 104 prints the print data, using the mixed color obtained by the obtaining unit 106.

[Mixed Color Selection Sheet]

Next, the mixed color selection sheet will be described.

Figure 3:
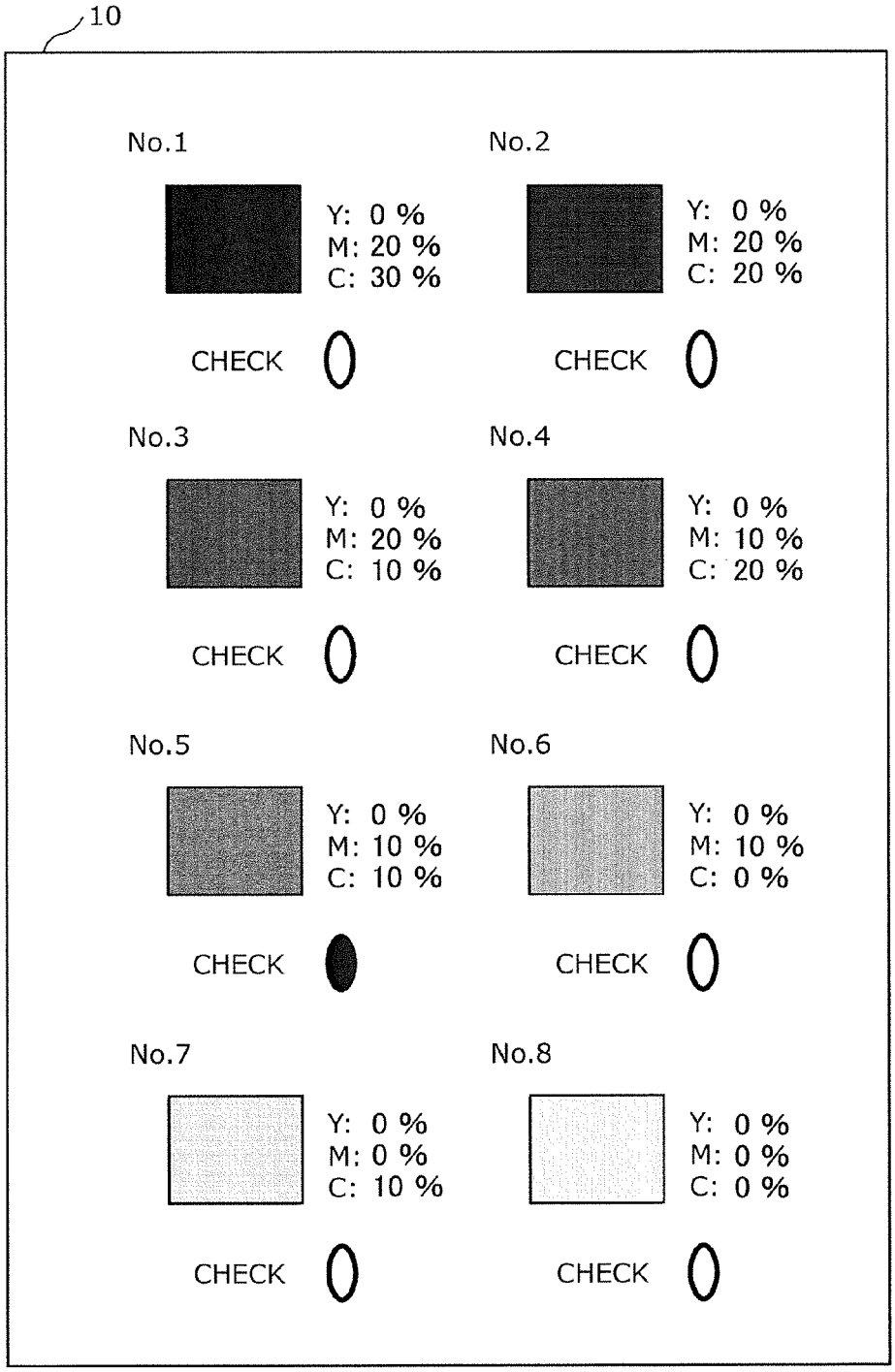
FIG. 3 is a diagram showing an example of a mixed color selection sheet according to the embodiment 1.

FIG. 3 is a diagram showing an example of the mixed color selection sheet according to the embodiment 1. A selection sheet 10 includes a plurality of sets of: a color sample for a mixed color, an indication of the remaining amounts of yellow, magenta, and cyan inks; and an ellipse indicating a region to be marked.

The indication of the remaining amounts of yellow, magenta, and cyan inks is expressed as percentages relative to the maximum volumes of the inks. For example, in FIG. 3, it is indicated that, if a mixed color of No. 1 were to be used for printing until the yellow ink is exhausted, 20% and 10% of the magenta ink and cyan ink, respectively, relative to their maximum volumes, would remain. Also for example, it is indicated that, if a mixed color of No. 5 were to be used for printing until the yellow ink is exhausted, 10% and 10% of the magenta ink and cyan ink, respectively, relative to their maximum volumes, would remain. In other words, it can be seen that if the mixed color information of No. 5 were to be selected, variations in ink usage can be reduced, although a color far from black (the original color) is used for printing, as compared to selecting the mixed color information of No. 1.

An ellipse represents a region to be marked by the user to select at least one piece of mixed color information from the plurality of pieces of mixed color information. In FIG. 3, a region defined by an ellipse of No. 5 is filled by the user. In other words, in FIG. 3, the user has selected the mixed color information of No. 5 from the plurality of pieces of mixed color information.

[Operation of Printer]

Next, operation of the printer 100 configured as set forth above will be described. Here, description will be given with reference to a case where the original color is black, and yellow, magenta, and cyan inks are used to render a plurality of mixed colors.

Figure 4:
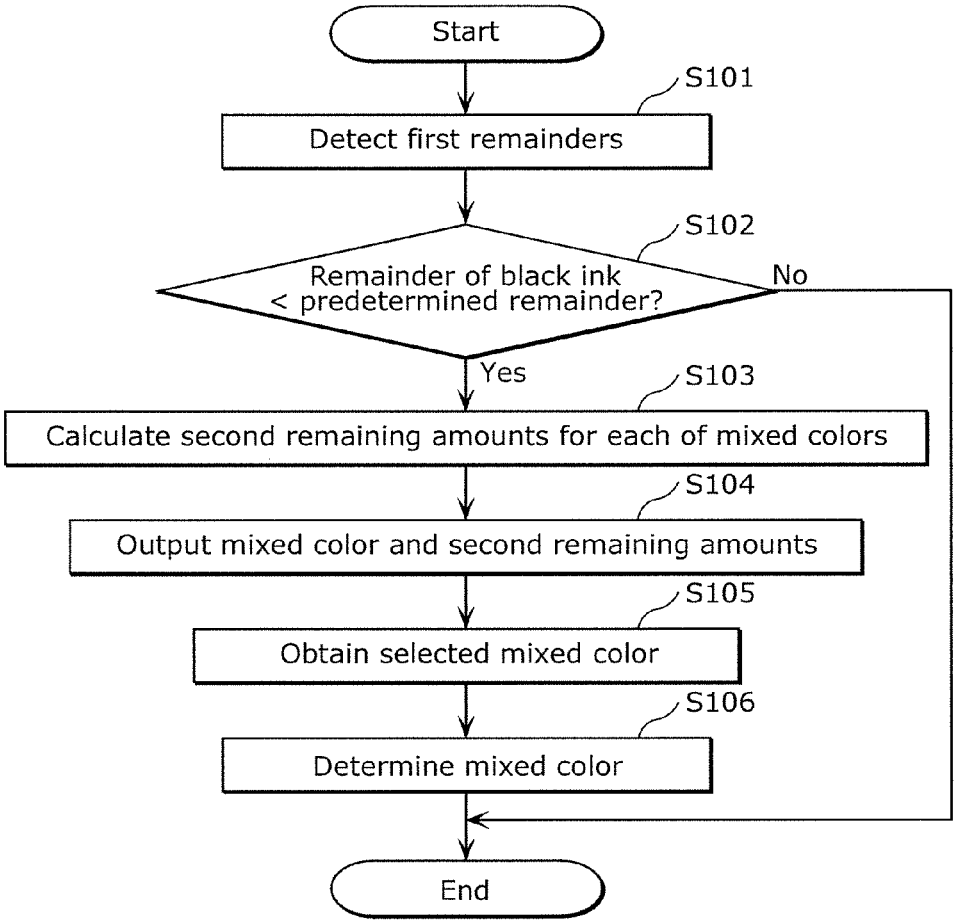
FIG. 4 is a flowchart illustrating a mixed color determination process performed by the printer according to the embodiment 1.

First, a mixed color determination process performed by the printer 100 will be described. FIG. 4 is a flowchart illustrating the mixed color determination process performed by the printer according to the embodiment 1.

First, the detection unit 101 detects the remaining amounts of the plurality of inks (S101).

The calculation unit 102 determines whether the remaining amount of black ink is less than a predetermined remaining amount (S102). The predetermined remaining amount is threshold for conserving the black ink. For example, 50% relative to the maximum volume of the black ink is the predetermined remaining amount.

Here, if the remaining amount of black ink is more than the predetermined remaining amount (No in S102), the processing ends without determining a mixed color. It should be noted that the original color of black ink (i.e., black) may be determined.

On the other hand, if the remaining amount of black ink is less than the predetermined remaining amount (Yes in S102), the calculation unit 102 calculates the second remaining amounts representing estimated remaining amounts of inks for each of mixed colors (S103). In other words, the calculation unit 102 estimates the second remaining amounts of inks for each mixed color if the mixed color were to be used as an alternative to black. In other words, the calculation unit 102 determines a mixed color if the remaining amount of black ink is below the predetermined threshold.

For example, if the remaining amount of yellow ink is less than the remaining amounts of magenta and cyan inks, the calculation unit 102 calculates second remaining amounts of inks for a plurality of mixed colors which use relatively small amounts of yellow ink. Specifically, if the distribution density of yellow, magenta, and cyan inks in a mixed color closest to black is (1:1:1), the calculation unit 102 calculates second remaining amounts of inks for a plurality of mixed colors that have distribution densities, such as (1:1:1), (1:0.9:1), (1:1:0.9), (1:0.9:0.9), for example.

The calculation unit 102 also calculates the estimated remaining amounts of inks for each of the mixed colors if the mixed color were to be used until any one of the inks is exhausted. For example, if the detected remaining amounts of yellow, magenta, and cyan inks are (50%, 70%, 80%, respectively), the calculation unit 102 calculates the second remaining amounts of the yellow, magenta, and cyan inks, if a mixed color having a distribution density of (1:1:1) were to be used for printing, to be (0%, 20%, 30%, respectively).

The output unit 103 outputs the plurality of pieces of mixed color information (S104). The plurality of pieces of mixed color information includes the mixed color and the second remaining amounts. Here, the output unit 103 outputs the plurality of pieces of mixed color information to the printing unit 104, and thereby the selection sheet is printed. The user confirms the printed color samples and the remaining amounts on the selection sheet and then marks a region corresponding to mixed color information which the user desires to select.

The obtaining unit 106 obtains the mixed color information selected by the user (S105). Here, the obtaining unit 106 obtains the mixed color information selected by the user, based on a result of the scanning unit 105 scanning the marked selection sheet.

The control unit 107 determines a mixed color to be used as an alternative to an original color in printing, based on a result obtained by the obtaining unit 106 (S106). For example, the control unit 107 stores information indicating the mixed color into a memory.

Figure 5:
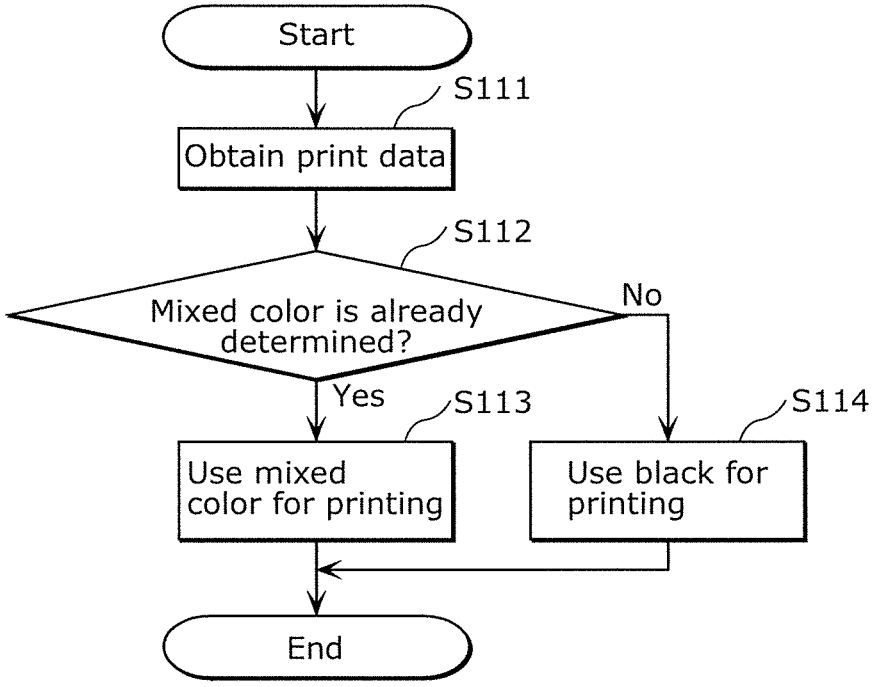
FIG. 5 is a flowchart illustrating a printing process performed by the printer according to the embodiment 1.

Next, a printing process performed by the printer 100 will be described. FIG. 5 is a flowchart illustrating a printing process performed by the printer according to the embodiment 1.

First, the control unit 107 obtains the print data (S111). Specifically, the control unit 107, for example, receives the print data from a communication device (e.g., a smartphone, a personal computer, etc) external to the printer 100. Also for example, the control unit 107 obtains image data generated by the scanning unit 105 as print data.

The control unit 107 determines whether a mixed color is already determined (S112). Here, if a mixed color is already determined (Yes in S112), the control unit 107 causes the printing unit 104 to use the mixed color as an alternative to black to print the print data (S113). On the other hand, if a mixed color is not determined yet (No in S112), the control unit 107 causes the printing unit 104 to use black as is to print the print data (S114).

[Effects]

As described above, according to the printer of the present embodiment, the plurality of pieces of mixed color information each of which includes the mixed color and the second remaining amounts can be output. Thus, the user is able to select a mixed color from a plurality of mixed colors, based on second remaining amounts corresponding to each mixed color. As a result, the user can select a mixed color whereby remaining-amount bias among the remaining amounts of a plurality of inks is reduced. In other words, the printer uses a mixed color selected as such for printing, thereby reducing, after at least one of a plurality of inks is exhausted, the remaining amounts of the other inks remaining. For example, if one cartridge includes a plurality of inks, the printer can reduce, when one of the inks is exhausted, the remaining amounts of the other inks, thereby reducing waste of inks due to exchange of cartridges.

Moreover, alternatively, the user can select a visually acceptable mixed color from a plurality of mixed colors. In other words, the user can select a mixed color in consideration of both the user's visual tolerances and a reduction in remaining-amount bias among the remaining amounts of a plurality of inks. Hence, the printer uses a mixed color thus selected by the user for printing, thereby allowing printing using a mixed color suitable for user's visual tolerances and the remaining amount of the plurality of inks.

Moreover, according to the printer of the present embodiment, color samples for the plurality of mixed colors and the indication of the second remaining amounts are printed. Thus, the mixed color information can be presented to the user through the printing capabilities of the printer. In other words, there is no need for providing means only for presenting mixed color information to the user. This allows printer configuration to be simplified.

Moreover, according to the printer of the present embodiment, at least one piece of mixed color selected by the user can be obtained based on a result of scanning a recording medium marked by the user. In this case, the user is allowed to directly enter user's selection onto the recording medium on which the color samples for the plurality of mixed colors and the indication of the second remaining amounts are printed. Thus, even a user who has poor computer literacy is able to readily select a mixed color, and user convenience is improved.

Variation 1

Next, a variation 1 according to the embodiment 1 will be described.

A printer according to the variation 1 is different from the printer according to the embodiment 1 in that a plurality of pieces of mixed color information are output to a display unit and selection of mixed color information by a user is obtained via an input unit in the printer according to the variation 1. In the following, differences of the printer according to the variation 1 from the embodiment 1 will mainly be described.

Figure 6:
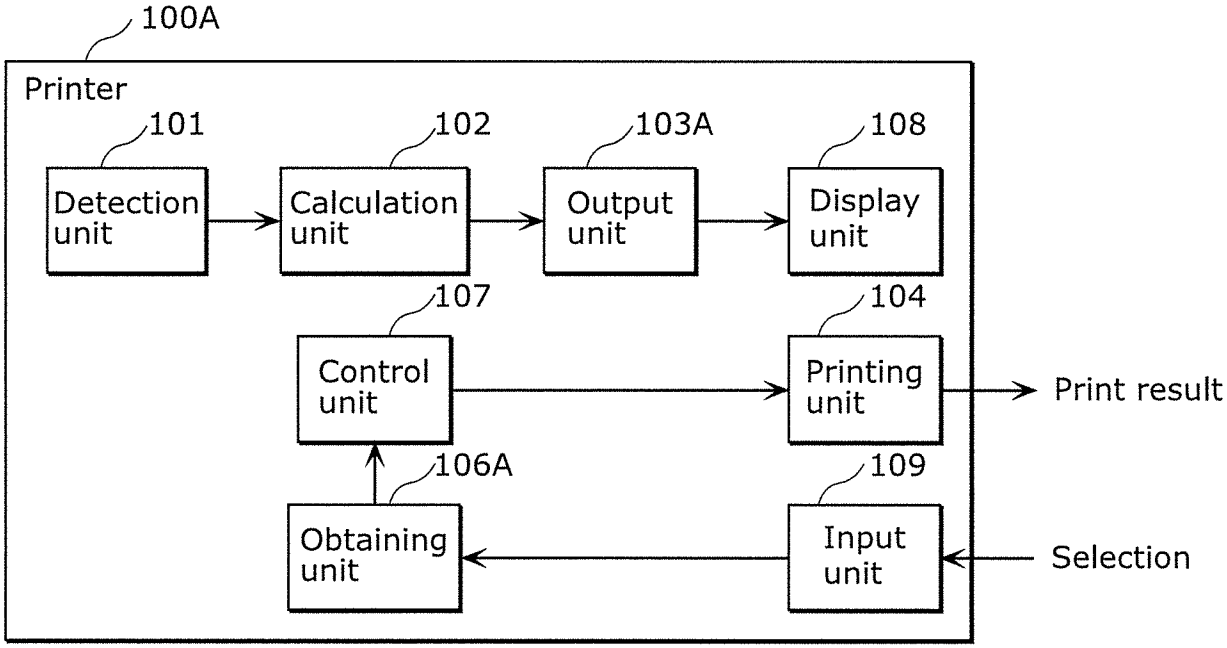
FIG. 6 is a block diagram showing functional configuration of a printer according to a variation 1 of the embodiment 1.

FIG. 6 is a block diagram showing functional configuration of the printer according to the variation 1 of the embodiment 1. It should be noted that the same reference signs are used in FIG. 6 to refer to components that have the same or similar functionalities to those shown in FIG. 2, and description will be omitted accordingly.

A printer 100A according to the variation 1 can, as with the printer 100 according to the embodiment 1, render an alternative color of one ink color among a plurality of inks of different colors, using the other inks among the plurality of inks. As shown in FIG. 6, the printer 100A includes a detection unit 101, a calculation unit 102, an output unit 103A, a printing unit 104, an obtaining unit 106A, a control unit 107, a display unit 108, and an input unit 109.

The output unit 103A outputs a plurality of pieces of mixed color information to the display unit 108. The mixed color information includes a mixed color and estimated remaining amounts (second remaining amounts) calculated, which correspond to the mixed color.

The display unit 108 is, for example, a liquid crystal display disposed on the front surface of the printer 100A. The display unit 108 displays the plurality of pieces of mixed color information. Specifically, the display unit 108, for example, displays content printed on the selection sheet shown in FIG. 3. At this time, a GUI element (e.g., a push button, a radio button, and a check box) for selecting a mixed color may be displayed instead of ellipses for marks.

The input unit 109 is, for example, an input device, such as a push button, disposed on the front surface of the printer 100A. The input unit 109 receives, from a user, input of mixed color information (selection) selected by the user from the plurality of pieces of mixed color information displayed on the display unit 108. For example, the input unit 109 receives input of a number of a piece of mixed color information ("5" in the case of FIG. 3) from the user.

It should be noted that the display unit 108 and the input unit 109 may integrally be implemented as a touch display.

The obtaining unit 106A obtains from the input unit 109 the mixed color information selected by the user from the plurality of pieces of mixed color information.

As described above, according to the printer 100A of the variation 1, even if the scanning unit is absent, effects similar to those obtained from the printer 100 according to the embodiment 1 can be obtained using the display unit and the input unit.

Variation 2

Next, a variation 2 according to the embodiment 1 will be described.

A printer according to the variation 2 is different from the printer according to the embodiment 1 in that a plurality of pieces of mixed color information are transmitted to a communication device external to the printer and that the printer receives selection of mixed color information made by a user from the communication device in the printer according to the variation 2. In the following, differences of the printer according to the variation 2 from the embodiment 1 will mainly be described.

Figure 7:
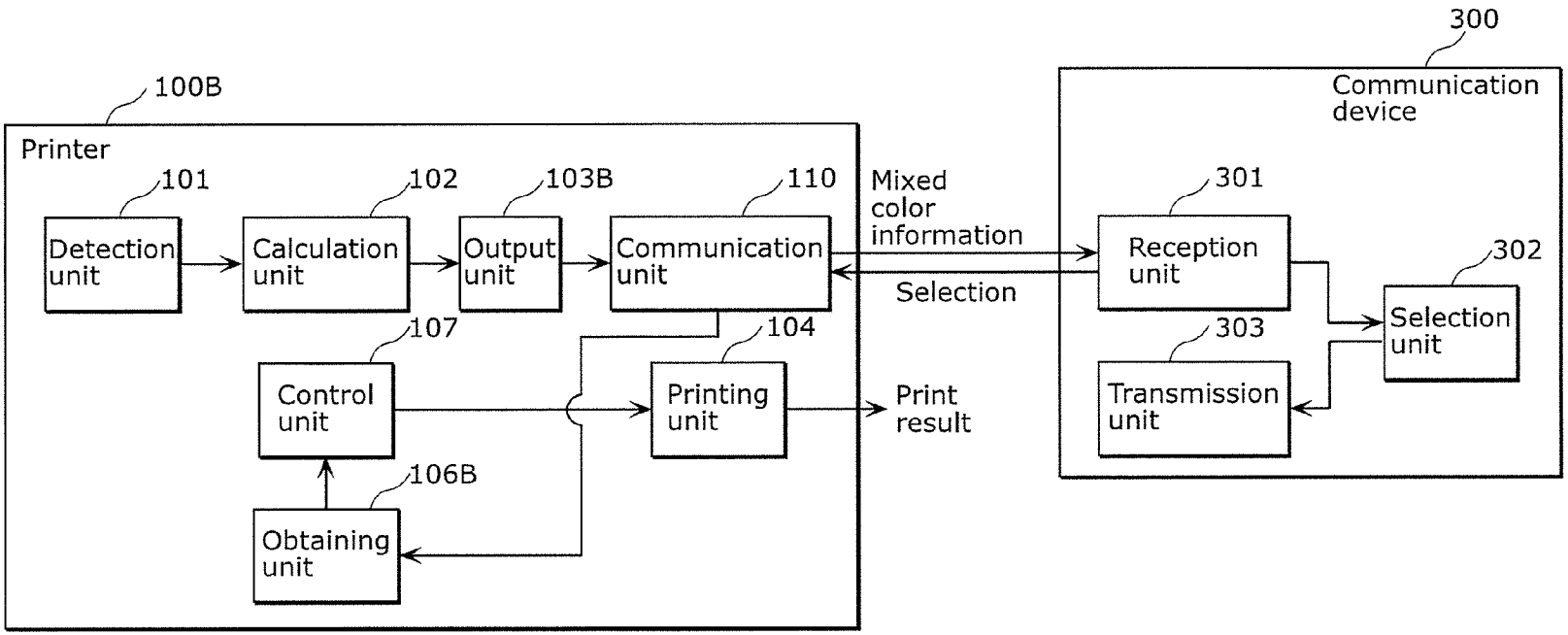
FIG. 7 is a block diagram showing functional configuration of a printer according to a variation 2 of the embodiment 1.

FIG. 7 is a block diagram showing functional configuration of the printer according to the variation 2 of the embodiment 1. It should be noted that the same reference signs are used in FIG. 7 to refer to components that have the same or similar functionalities to those shown in FIG. 2, and description will be omitted accordingly.

A printer 100B according to the variation 2 can, as with the printer 100 according to the embodiment 1, render an alternative color of one ink color among a plurality of inks of different colors, using the other inks among the plurality of inks.

A communication device 300 corresponds to a terminal device and is communicably connected to the printer 100B. The communication device 300 is, for example, a smartphone, a tablet, a personal computer, etc.

As shown in FIG. 7, the printer 100B includes a detection unit 101, a calculation unit 102, an output unit 103B, a printing unit 104, an obtaining unit 106B, a control unit 107, and a communication unit 110.

The output unit 103B outputs a plurality of pieces of mixed color information to the communication unit 110. The mixed color information includes a mixed color and estimated remaining amounts (second remaining amounts) calculated, which correspond to the mixed color.

The communication unit 110 communicates with the communication device 300 over, for example, a wireless LAN (local area network), a wired LAN, Bluetooth (registered trademark), etc. Specifically, the communication unit 110 transmits the plurality of pieces of mixed color information to the communication device 300.

The communication device 300 includes a reception unit 301, a selection unit 302, and a transmission unit 303.

The reception unit 301 receives information from the communication device 300 over, for example, a wireless LAN, a wired LAN, Bluetooth, etc. Specifically, the reception unit 301 receives the plurality of pieces of mixed color information from the printer 100B.

The selection unit 302 selects one piece of mixed color information from the plurality of pieces of mixed color information. For example, the selection unit 302 presents color samples for the plurality of mixed colors and the second remaining amounts to the user, based on the plurality of pieces of mixed color information. The selection unit 302 then receives input of selection from the plurality of pieces of mixed color information from the user, thereby selecting one piece of mixed color information from the plurality of pieces of mixed color information.

The transmission unit 303 transmits information to the communication device 300 over, for example, a wireless LAN, a wired LAN, Bluetooth, etc. Specifically, the transmission unit 303 transmits the mixed color information selected by the user to the printer 100B.

The obtaining unit 106B obtains via the communication unit 110 the mixed color information selected by the user.

As described above, according to the printer 100B of the variation 2, even if the scanning unit, the display unit, and the input unit are absent, effects similar to those obtained from the printer 100 according to the embodiment 1 can be obtained using the communication device 300 external to the printer 100B.

Embodiment 2

Next, an embodiment 2 according to the present invention will be described.

A printer according to the present embodiment is different from the printer according to the embodiment 1 in that the printer according to the present embodiment can be switched between a mixed-color mode in which a mixed color is used for printing and an original-color mode in which an original color is used for printing. In the following, differences of the printer according to the present embodiment from the embodiment 1 will mainly be described.

[Functional Configuration of Printer]

Figure 8:
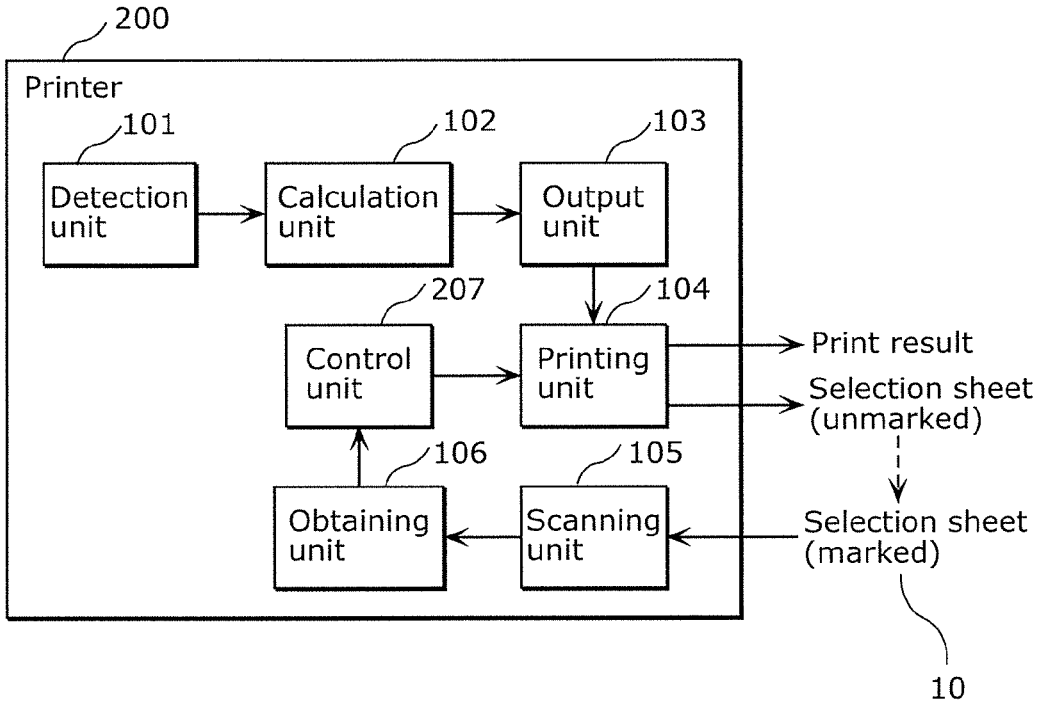
FIG. 8 is a block diagram showing functional configuration of a printer according to an embodiment 2.

FIG. 8 is a block diagram showing functional configuration of the printer according to the embodiment 2. It should be noted that the same reference signs are used in FIG. 8 to refer to components that have the same or similar functionalities to those shown in FIG. 2, and description will be omitted accordingly.

A printer 200 according to the present embodiment can, as with the printer 100 according to the embodiment 1, render an alternative color of one ink color among a plurality of inks of different colors, using the other inks among the plurality of inks.

As shown in FIG. 8, the printer 200 includes a detection unit 101, a calculation unit 102, an output unit 103, a printing unit 104, a scanning unit 105, an obtaining unit 106, a control unit 207, and a communication unit 110.

The control unit 207 switches the printer 200 between the mixed-color mode in which a mixed color is used for printing and the original-color mode in which an original color is used for printing. Specifically, the control unit 207 switches the printer 200 between the mixed-color mode and the original-color mode, based on, for example, input from a user to an input device included in the printer 200.

Also for example, the control unit 207 may switch the printer 200 between the mixed-color mode and the original-color mode according to a quality of a recording medium used for printing. Specifically, the control unit 207 may set the printer 200 to the mixed-color mode when copier paper is used and to the original-color mode when photo paper is used. At this time, whether copier paper or photo paper is used may be determined based on a feed tray used.

Also for example, the control unit 207 may switch the printer 200 between the mixed-color mode and the original-color mode according to information from a communication device, i.e., destination of print data. Specifically, the control unit 207 receives printing quality (e.g., low quality, normal, high quality) from the communication device and switches the printer 200 between the mixed-color mode and the original-color mode, according to the printing quality. More specifically, the control unit 207 may set the printer 200 to the mixed-color mode if the printing quality is low quality and to the original-color mode if the printing quality is high quality.

Also for example, the control unit 207 may switch the printer 200 between the mixed-color mode and the original-color mode, based on a remaining amount of one original color. Specifically, the control unit 207 may compare a remaining amount of an ink of one original color with threshold and switch the printer 200 between the mixed-color mode and the original-color mode based on a result of the comparison. More specifically, the control unit 207 may set the printer 200 to the original-color mode if a remaining amount of an ink of one original color is more than the threshold and to the mixed-color mode if the remaining amount of the ink of the original color is less than the threshold.

In other words, the control unit 207 may adaptively switch the printer 200 between the mixed-color mode and the original-color mode according to, for example, content of the print data, a type of recording medium, instructions from the user, the remaining amount of an ink of an original color, etc.

Furthermore, the control unit 207 controls the printing unit 104 based on whether the printer 200 is in the mixed-color mode or in the original-color mode. In other words, the control unit 207 controls the printing unit 104 to print using a mixed color in (i) the mixed-color mode and print using an original color in (ii) the original-color mode.

[Operation of Printer]

Next, operation of the printer 200 configured as set forth above will be described. It should be noted that a mixed color determination process performed by the printer 200 is the same as that in the embodiment 1, and thus description will be omitted.

Figure 9:
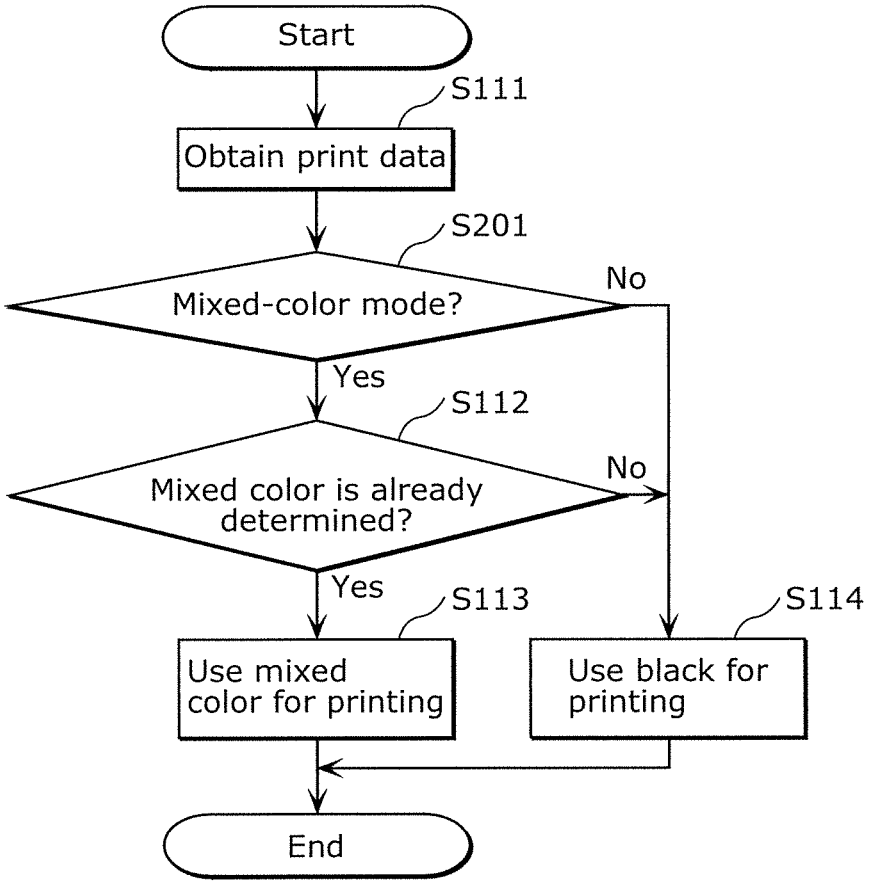
FIG. 9 is a flowchart illustrating a printing process performed by the printer according to the embodiment 2.

FIG. 9 is a flowchart illustrating a printing process performed by the printer according to the embodiment 2. It should be noted that the same reference signs are used in FIG. 9 to refer to steps which perform the same or similar processes to those shown in FIG. 4, and description will be omitted accordingly.

After the print data is obtained (S111), the control unit 207 determines whether the printer 200 is set to the mixed-color mode (S201). Here, if the printer 200 is set to the mixed-color mode (Yes in S201), the control unit 207 determines whether a mixed color is determined (S112). On the other hand, if the printer 200 is not set to the mixed-color mode (No in S201), the print data is printed using black (i.e., original color) as is (S114).

[Effects]

As described above, according to the printer of the present embodiment, the mixed-color mode and the original-color mode can be switched therebetween. Thus, mixed color printing and non-mixed color printing may be adaptively switched therebetween according to, for example, content of the print data, a type of recording medium, instructions from the user, etc.

Other Embodiments

While the printer according to the embodiments of the present invention has been described, the present invention is not limited to the embodiments. Various modifications to the present embodiments that may be conceived by those skilled in the art or combinations of the components of different embodiments are intended to be included within the scope of the invention, without departing from the spirit of the present invention.

For example, while the above embodiments have been described with reference to the case where the printer is an inkjet printer, the present invention is not limited thereto. The printer may be a laser printer. In this case, toners are used instead of inks.

While the plurality of coloring materials are black, yellow, magenta, and cyan inks in the above embodiments, the colors and the numbers of the coloring materials are not limited thereto. For example, the plurality of coloring materials may include coloring materials of light magenta, light cyan, green, and red, in addition to the coloring materials of black, yellow, magenta, and cyan.

While the above embodiments has been described with reference to the case where a mixed color as an alternative to black is used for printing, a mixed color may be used as an alternative to a color different from black.

While the user marks a mixed color selection sheet in the above embodiments, the user may write a character or a combination of a character and a mark. For example, the user may write a number for identifying a mixed color (e.g., "5") to the selection sheet. In this case, the obtaining unit recognizes a number written by the user from a scan result (an image), thereby obtaining the mixed color selected by the user.

While the remaining amounts of color inks used for the mixed color are expressed as percentages relative to their maximum volumes in the above embodiments, the present invention is not limited thereto. For example, the reminders amounts of color inks used for the mixed color may be expressed as absolute amounts (e.g., 5 milliliter).

While the above embodiments have been described with reference to the cases where the user selects one piece of mixed color information from the plurality of pieces of mixed color information, two or more pieces of mixed color information may be selected. In this case, the obtaining unit may obtain two or more pieces of mixed color information and select one piece of mixed color information from the two or more pieces of mixed color information. For example, the obtaining unit may select one piece of mixed color information from the two or more pieces of mixed color information, according to a sum of second remaining amounts. Specifically, the obtaining unit may automatically select, from the two or more pieces of mixed color information, a piece of mixed color information in which a sum of second remaining amounts is the smallest.

While a mixed color is determined if the remaining amount of black ink is less than a predetermined remaining amount in the above embodiments, criteria for determining a mixed color are not limited thereto. For example, whether a value indicating remaining-amount bias between the remaining amounts of yellow, magenta, and cyan is greater than threshold may be used as a criterion for determining a mixed color. Specifically, a mixed color may be determined if a difference value between the maximum remaining amount and the minimum remaining amount among the remaining amounts of yellow, magenta, and cyan is greater than threshold.

It should be noted that the way of calculating the second remaining amounts is not limited to the examples described in the above embodiments. For example, the second remaining amounts may be estimated based on an image previously printed.

While the printer includes the control unit in the above embodiments, the control unit may be included in the printing unit.

Although only some exemplary embodiments of the present invention have been described in detail above, those skilled in the art will readily appreciate that many modifications are possible in the exemplary embodiments without materially departing from the novel teachings and advantages of the present invention. Accordingly, all such modifications are intended to be included within the scope of the present invention.

INDUSTRIAL APPLICABILITY

The present invention is applicable to, for example, color inkjet printers which use a plurality of inks of different colors for printing and color laser printers which use a plurality of toners of different colors for printing.

The invention claimed is:

1. A printer comprising:

a detection unit that detects first remaining amounts of inks;

a generation unit that generates a plurality of mixed color information on mixed colors having different distribution densities of the inks, the plurality of mixed color information each including a mixed color among the mixed colors and second remaining amounts of the inks representing estimated remaining amounts of the inks based on the first remaining amounts if the mixed color were to be used for printing; and an obtaining unit that obtains mixed color information selected from the plurality of mixed color information.

2. The printer according to claim 1, further comprising a control unit that switches between a mixed-color mode in which the mixed color is used for printing and an original-color mode in which an original color is used for printing.

3. The printer according to claim 2, wherein the control unit switches between the mixed-color mode and the original-color mode, based on a remaining amount of an ink of the original color.

4. The printer according to claim 2, wherein the control unit switches between the mixed-color mode and the original-color mode, according to a type of a medium.

5. The printer according to claim 2, wherein the control unit switches between the mixed-color mode and the original-color mode, according to a printing quality designated.

6. The printer according to claim 1, further comprising:

a display unit; and an output unit that outputs the plurality of mixed color information to the display unit.

7. The printer according to claim 6, further comprising an input unit, wherein the display unit and the input unit are implemented as a touch display.

8. The printer according to claim 1, further comprising a printing unit that prints color samples for the mixed colors, and an indication of the second remaining amounts onto a medium, based on the plurality of mixed color information.

9. The printer according to claim 8, further comprising a scanning unit, wherein the scanning unit optically scans the medium on which a pattern representing the selected mixed color information is described, and the obtaining unit obtains the selected mixed color information, based on a result of the scanning unit scanning the medium.

10. The printer according to claim 1, further comprising a communication unit that transmits the plurality of mixed color information to a terminal device and receives the mixed color information selected in the terminal device.

11. The printer according to claim 1, wherein the obtaining unit selects the mixed color information from the plurality of mixed color information, according to a sum of the second remaining amounts.

12. A terminal device comprising:

a reception unit that receives, from a printer, a plurality of mixed color information on mixed colors having different distribution densities of inks, the plurality of mixed color information each including a mixed color among the mixed colors, and second remaining amounts of the inks representing estimated remaining amounts of the inks if the mixed color were to be used for printing;

a selection unit that selects mixed color information from the plurality of mixed color information; and a transmission unit that transmits the selected mixed color information to the printer.

13. A method for obtaining information in a printer using inks, comprising:

detecting first remaining amounts of the inks;

generating a plurality of mixed color information on mixed colors having different distribution densities of the inks, the plurality of mixed color information each including a mixed color among the mixed colors, and second remaining amounts of the inks representing estimated remaining amounts of the inks based on the first remaining amounts if the mixed color were to be used for printing; and obtaining mixed color information selected from the plurality of mixed color information.

* * * * *